US005488851A

United States Patent [19]

Rossi

[11] Patent Number: 5,488,851

[45] Date of Patent: Feb. 6, 1996

[54] MULTISTAGE WIREDRAWING MACHINE PROVIDED WITH PULL ADJUSTMENT

[75] Inventor: Attilio Rossi, Legnano, Italy

[73] Assignee: Redaelli Tecna Meccanica S.p.A., Milan, Italy

[21] Appl. No.: 275,707

[22] Filed: Jul. 18, 1994

[30] Foreign Application Priority Data

Sep. 3, 1993 [IT] Italy ..... MI93A1889

[51] Int. Cl.[6] ..... B21C 1/30

[52] U.S. Cl. ..... 72/279; 72/288

[58] Field of Search ..... 72/279, 288, 280, 72/278

[56] References Cited

U.S. PATENT DOCUMENTS 2,263,246 11/1941 Morgan ..... 72/279
2,417,780 3/1947 Parvin ..... 72/279
3,646,798 3/1972 Alcock ..... 72/288
5,247,823 9/1993 Rossi ..... 72/279

FOREIGN PATENT DOCUMENTS 517340 12/1992 European Pat. Off. ..... 72/288
MI91A1534 6/1991 Italy .

*Primary Examiner*—Daniel C. Crane
*Attorney, Agent, or Firm*—Stevens, Davis, Miller & Mosher

[57] ABSTRACT

A wiredrawing machine (10) consists of a plurality of stages (11) in cascade, each stage comprising a drawbench (13) for passage of the wire (14) partially passed over a power-driven traction pulley (12). The traction pulley is kinematically connected for operation to a first gear (17) having a power-driven planetary gear (19) meshing therewith and rotating about the first gear (17) periphery. Sensor means (23) detects the angular position of the planetary gear (19) about the axis of the first gear (17) and sends position signals to a control circuit (24) which in turn sends commands for speed adjustment to motor (16), in terms of keeping the planetary gear at predetermined angular positions about the first gear.

7 Claims, 1 Drawing Sheet

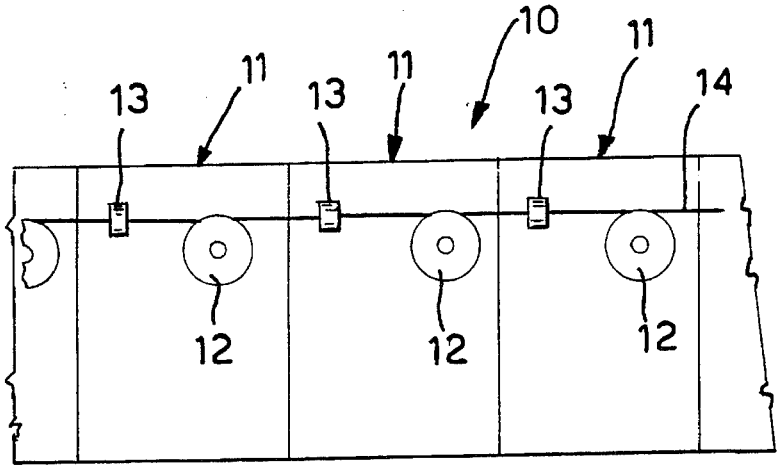
Fig.1
Fig.2
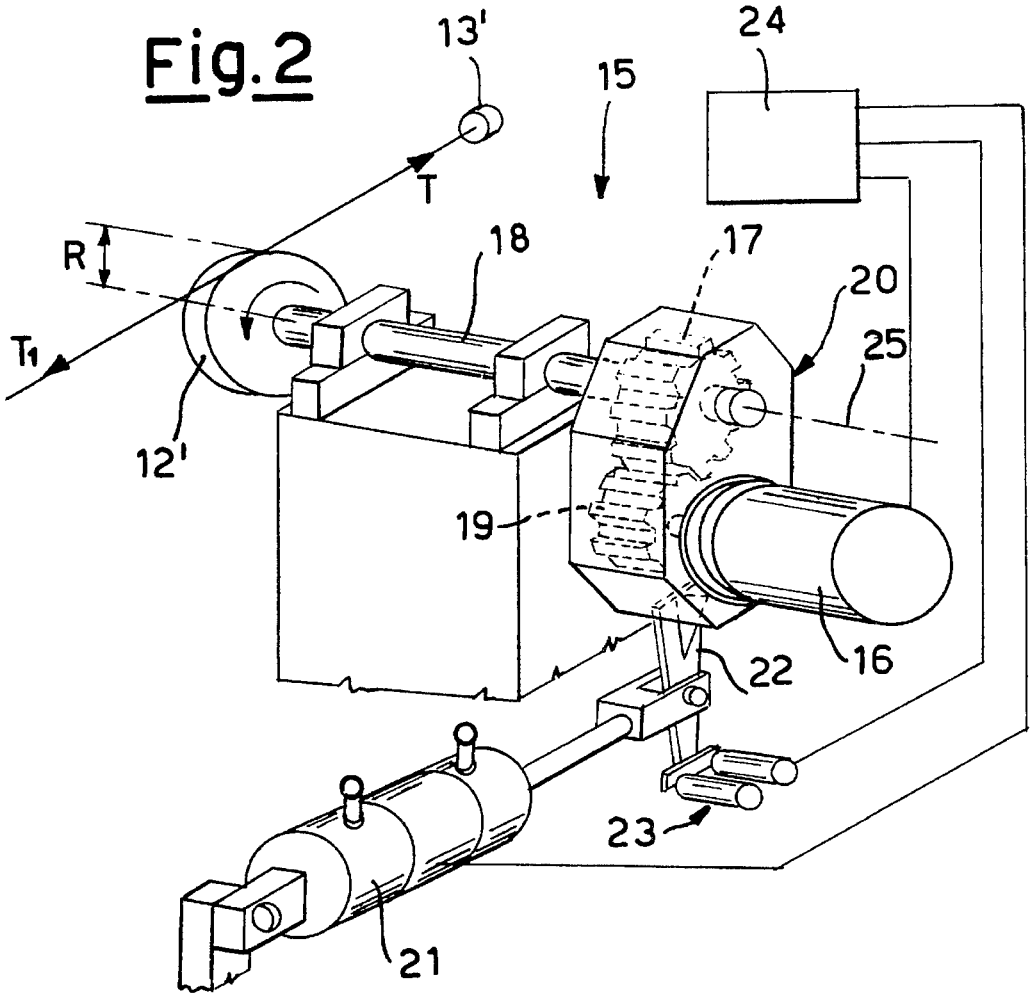

MULTISTAGE WIREDRAWING MACHINE PROVIDED WITH PULL ADJUSTMENT

BACKGROUND OF THE INVENTION

The present invention relates to a direct-pull multistage wiredrawing machine.

Multistage wiredrawing machines are known in which the wire to be drawn is successively passed through drawbenches having decreasing sections. In order to avoid tensions to be generated that would bring to the wire breakage, it is necessary to keep the product of the wire section by the wire speed constant. Therefore rollers are generally used over which the wire length located between two drawbenches is wrapped and which are driven in rotation by electric motors operated in such a manner as to produce the traction action necessary for that wire length. Several different solutions have been proposed for performing the function of adjusting the motors' speed. For example it has been proposed to carry out the motors' adjustment (either manually or with the aid of automatic or semiautomatic devices) so as to produce a torque slightly lower than that necessary to start drawing. After that, the last motor of the drawing machine is adjusted for supplying a pulling action enabling the immediately preceding motor to rotate, so that, in turn, the last mentioned motor will produce a pulling action transmitted to the motor immediately preceding it, and so on as far as the whole drawing train is set in motion. Such a drawing machine can be used only for working wires which are sufficiently big to withstand the pulling forces that are generated during transient steps and which produce spreading of "jerks" along the different stages. Also proposed have been wiredrawing machines having sensors disposed along the wire lengths between the rollers in order to detect the wire tension and drive the motors so as to keep said tension to an acceptable value. Usually said sensors consist of feeler pins or takeup rollers on which the wire rests and over which it is wrapped. The sensor movement is converted to electric signals piloting the speed control devices of the electric motors. In addition to the mechanical complexity introduced by the plurality of movable feeler pins or takeup rollers disposed along the wire lengths, the deformations imposed to the wire by such sensors in order to be able to detect tensioning of same submit the wire to undesired stresses.

"Storage" drawing machines have been also proposed in which, in place of the speed control, wire storing means is used for accumulating the wire between the different drawing machines, so that stages are isolated from one another as much as possible and spreading of pulls is avoided, However, wire storing gives rise to unavoidable wire bendings and twistings that, together with the uncontrolled pulling actions that can take place in the storing means itself, cause concealed tearings in the material or even breakage of the wire at the solderings, or microdefects.

In the Italian Patent Application No. MI91A001584 filed in the name of the same applicant a multistage wiredrawing machine is described. Each pulling roller is fitted on a gear meshing with a planetary gear rotating about the former. Kinematically connected to the planetary gear is, in turn, one pulley passed over by a length of a belt driven by a second pulley fitted to a motor. The second pulley is an expanding pulley, that is its diameter varies on varying of the belt tension so that increasing or decreasing in the torque transmitted between the gears causes the pignon to rotate about the gear thereby tensioning or releasing the belt and therefore varying the transmission ratio between the pulleys.

While such an embodiment offers a fair adjustment of the wire tensions; it has a relatively expensive mechanical structure and relatively high intervention thresholds, as the wire tension has to overcome the value necessary to impose the diameter variation in the expanding pulley. In addition, it has a rather important bulkiness. The general object of the present invention is to eliminate the above mentioned drawbacks by providing a multistage wiredrawing machine provided with a system for controlling the wire speed and tension in working, which system is capable of preventing abnormal stresses in the wire while being of simple mechanical structure, quick intervention and very high sensitivity.

SUMMARY OF THE INVENTION

In view of the above object, in accordance with the present invention, a wiredrawing machine has been devised which consists of a plurality of stages in cascade, each stage comprising a drawbench for passage of the wire partially passed over a power-driven traction pulley, the traction pulley being kinematically connected for operation to a first gear having a planetary gear meshing therewith, said planetary gear being supported by movement means so that it rotates about the first-gear periphery, the planetary gear being kinematically connected to a driving motor, characterized in that each stage comprises sensor means for detecting the angular position of the planetary gear about the axis of the first gear, said sensor means sending position signals to a control circuit which in turn sends commands for speed adjustment to said motor, in terms of keeping the planetary gear at predetermined angular positions about the first gear.

BRIEF DESCRIPTION OF THE DRAWINGS

For better explaining the innovatory principles of the present invention and the advantages it offers over the known art, a possible embodiment of the invention putting into practice said innovatory principles will be given hereinafter, by way of non-limiting example, with the aid of the accompanying drawings, in which:

FIG. 1 is a partial, diagrammatic, elevational front view of a multistage wiredrawing machine in accordance with the invention;

FIG. 2 is a diagrammatic perspective view of a driving device for one stage of the machine shown in FIG. 1.

DETAILED DESCRIPTION OF THE INVENTION

Referring to the drawings, a wiredrawing machine, generally denoted by 10, consists of a plurality of sequentially disposed stages 11 for drawing a wire 14. Each stage 11 comprises a traction pulley 12 over which the wire is passed so that it is pulled along through a drawbench 13. As usual in drawing multistage installations, drawbenches have a decreasing diameter so as to bring the wire to the desired final diameter. Diagrammatically shown in FIG. 2 is a driving mechanism 15 for transmitting motion between a traction pulley and an electric motor 16. This driving mechanism is substantially the same in all stages 11 and its description will be therefore referred to a non-specific stage 11, comprising a traction pulley 12' and a drawbench 13'. The traction pulley 12' is kinematically connected to a first gear 17, by fitting to a common shaft 18 for example, which at one end has the pulley fitted thereon and at the other end carries the first gear, A second gear 19, or planetary gear, is supported by a framework 20 so that it meshes with the first gear 17. The framework 20 is rotatably supported about the axis 25 of the first gear 17, so that the planetary gear can freely rotate about the first gear 17 being always in engagement therewith. The planetary gear 19 is in turn kinematically connected to the electric motor 16 which is also supported by the framework 20 and moves about the axis 25 of the first gear together with the planetary gear.

Advantageously, the planetary gear is directly fitted to the shaft of motor 16, although the use of a further transmission gear therebetween may be envisaged. The free rotation of the planetary assembly comprised of the framework with the motor and planetary gear is counteracted by elastic means 21, for example comprising an elastic element consisting of a pneumatic spring of known art connected to an arm 22 projecting from the framework.

Sensor means 23 detects the rotation angle of the planetary assembly about the axis of the first gear 17 and sends signals being a function of said angle to a control circuit 24 controlling operation of the electric motor 16. The circuit 24 can be an electronic circuit essentially of known art (and therefore not further shown or described), and easily conceivable by a person skilled in the art above all on the basis of the following description concerning operation.

Circuit 24 may be for example a known suitably-programmed microprocessor circuit.

Sensors 23 can be of any known type, such as encoders, proximity sensors, potentiometers, etc. Said sensors may be positioned at the end of an arm, for example lever 22 as shown in FIG. 2, or directly coaxial with the axis of gear 17. In use, the drawing torque created by pulling of the wire will tend to cause rotation of the planetary assembly about the first gear 17 and such an action will be counteracted by the elastic force produced by the spring element 21.

On starting of the drawing stage, the only pulling force T is present which is proportional to the section reduction dictated by the corresponding drawbench.

The reduction gear, due to the drawing torque T×R (R being the traction pulley diameter), tends to rotate about the axis 25 and will load the spring element 21. As a result, the resisting moment necessary to drawing is created. The spring means produces an elastic force that can be adjusted pneumatically, mechanically or with other known means depending on the required drawing torque necessary for the particular working. For example, adjustment of the spring means 21 may take place through circuit 24, to which the values of the different working parameters are inputted.

The drawing block 11 therefore will begin working, pulling the wire through the drawbench 13' while exerting an effort T.

After passing the drawbench and being wrapped some coils around the pulley 12' of the stage 11 in question, the wire passes to the next stage. Along the wire length coming out of the pulley there will be a pull T1 (counter-pull) depending on pull T of the subsequent stage.

Pull T1 must have a value sufficient to prevent slackening of the wire on the pulley, but said value must not be higher than the pulling value that the wire can withstand, that is its breaking load.

Sensors 23 detect the angular position taken by the planetary assembly and communicate it to the control circuit 24. This angular position reaches a balance condition when a balance exists between the resisting moment produced by the spring element and the torques acting on the pulley due to pull T and counter-pull T1. It will be recognized that if pull T decreases or counter-pull T1 increases, the planetary assembly will move counterclockwise, whereas if pull T increases or counter-pull T1 decreases the planetary assembly will move clockwise. Such movements will be detected by the sensors, and the control circuit will increase or decrease the motor speed respectively, as far as the predetermined balance condition corresponding to the ideal pull and counter-pull values is reached again.

Practically, the control circuit adjusts the motor speed so as to keep the balance position detected by the sensors constant, so that pull and counter-pull will be kept constant too.

In other words, if the drawing speed in one stage becomes lower than the required speed for serving the next stage, there is an increase in the counter-pull and consequently the stage increases its drawing speed, thereby returning to the appropriate operating pitch. Likewise, in the opposite case, if a stage has a drawing speed which is too high as compared to the required one for serving the subsequent stage, the counter-pull will decrease and, as a result, the stage will decrease its speed.

Therefore, with a multistage wiredrawing machine in accordance with the invention, the last stage is provided to operate as a pilot bench, all the preceding stages adjusting their speeds in cascade based on the drawing speed of said last stage.

During the wire threading all stages work at the minimum speed and only when threading has been completed the speed of the last pilot block modifies the speed of all the preceding stages that carry out self-adjustment in cascade.

By virtue of the innovatory principles herein claimed, operation of each stage is always perfectly appropriate to the requirements of the other drawing machine stages, although connections between the control means of the different stages are not required. The adjustment time after a transient is, in addition, very short, thanks to the mechanical and electronic combination of the described detection system and therefore wire "jerks" and slippings are avoided.

Obviously the above description of one embodiment applying the innovatory principles of the invention is given for purposes of illustration only and therefore must not be considered as a limitation of the scope of the invention as claimed in the claims.

For example, the description and illustration of the wiredrawing machine has been made paying particular attention to the innovatory elements herein claimed. Obviously, as a person of ordinary skill in the art will readily understand, such a machine can be provided with all elements usual in drawing machines such as wire guides, breakage sensors, etc.

The electric motor identified as a motor generally adjusted in speed by the control system 24, can be of any type suitable for the application in question add therefore the speed control circuit will provide the appropriate known adjustment means suitable for it. For example, the motor can be either a D.C. or an A.C. motor provided with frequency converters, or be a hydraulic motor, a pneumatic motor and so on.

Finally, the support and movement means for the planetary gear may be different from those shown. For example, instead of a box-shaped framework, an open framework or the like may be used.

What is claimed is:

1. A wiredrawing machine consisting of a plurality of stages in cascade, each stage comprising a drawbench for passage of the wire, a power-driven traction pulley over which the wire is partially passed, a first gear kinematically connected for operation to said traction pulley, a planetary gear meshing with said first gear, movement means, mounted separate from said traction pulley, to support said planetary gear so that it rotates about the first gear periphery, a driving motor kinematically connected to said planetary gear, a sensor means for detecting the angular position of the planetary gear about an axis of said first gear, and a control circuit to which is sent position signals from said sensor means, which control circuit in turn sends commands for speed adjustment to said motor to keep the planetary gear at a predetermined annular position with respect to the first gear.

2. The machine according to claim 1, wherein said movement means comprises spring means counteracting rotation of the planetary gear about the first gear upon the action of the torque produced by the drawing pull.

3. The machine according to claim 1, wherein said movement means comprises a support axially bearing the planetary gear, the support being freely supported according to an axis coaxial with the axis of the first gear.

4. The machine according to claim 3, wherein said support bears the motor.

5. The machine according to claim 4, including a shaft for said motor and wherein said planetary gear is fitted to said shaft of said motor.

6. The machine according to claim 2, including a lever projecting from said support, which lever is connected to the spring means.

7. The machine according to claim 6, wherein said lever has one end close to the sensor means for detection of said angular position.

* * * * *